United States Patent [19]

Gantz

[11] 4,237,914

[45] Dec. 9, 1980

[54] BED TENT

[76] Inventor: Emmett J. Gantz, 1007 S. 14th St., Burlington, Iowa 52601

[21] Appl. No.: 947,061

[22] Filed: Sep. 29, 1978

Related U.S. Application Data

[63] Continuation-in-part of Ser. No. 850,496, Nov. 11, 1977, abandoned.

[51] Int. Cl.[3] ..... A45F 1/02; A45F 1/06

[52] U.S. Cl. ..... 135/4 R; 135/1 R; 135/DIG. 6; 52/2

[58] Field of Search ..... 135/DIG. 6, 4 R, 4 A, 135/1 R, 3 R, 5.1; 5/317 R; 52/70, 71, 2

[56] References Cited

U.S. PATENT DOCUMENTS

| | | | |
|---|---|---|---|
| 551,977 | 12/1895 | Long | 135/1 R |
| 837,937 | 12/1906 | Legg | 52/71 |
| 1,014,554 | 1/1912 | Zent | 182/175 |
| 1,892,378 | 12/1932 | Bernstein | 135/5.1 |
| 2,223,911 | 12/1940 | Garnette | 182/175 |
| 2,420,898 | 5/1947 | Miner | 135/1 |
| 2,600,501 | 6/1952 | Higgs | 128/1 |
| 2,739,861 | 3/1956 | Mahr | 108/6 |
| 3,522,635 | 8/1970 | Nilsson | 24/73 |
| 3,578,003 | 5/1971 | Everett | 135/4 R |
| 3,807,104 | 4/1974 | Webster | 135/4 R |
| 3,847,170 | 11/1974 | Anderson | 135/1 R |

*Primary Examiner*—Reinaldo P. Machado
*Attorney, Agent, or Firm*—Saidman & Sterne

[57] ABSTRACT

A portable folding tent which is adapted to be erected over a child's bed thereby enabling the child to camp out under a tent in his own bed. Several basic embodiments of the tent are provided. One has substantially rigid sides, while another includes a light tubular frame with a soft cover stretched thereover and secured thereto. The rigid sided embodiment may be reversible and have different figurines or decorations on the side walls thereof. Another embodiment may provide for inflatable tent sides so that the structure may be utilized as either a tent or a floatable raft. Other features include a hinged top in combination with an adjustable member for setting the width of the tent to any desired angle. Anchor straps attach to the lower portion of the tent and may be used to secure the tent to the bed or ground.

15 Claims, 20 Drawing Figures

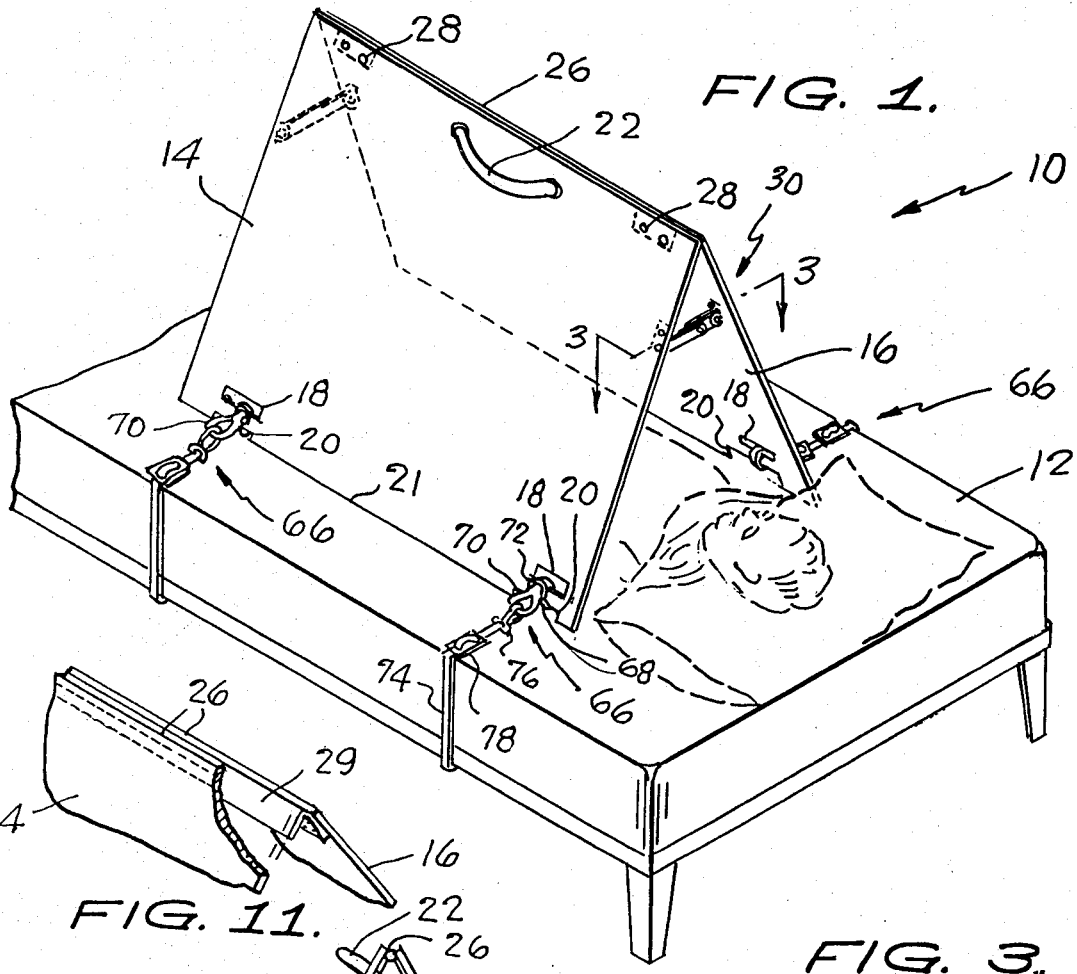
FIG. 1.
FIG. 11.
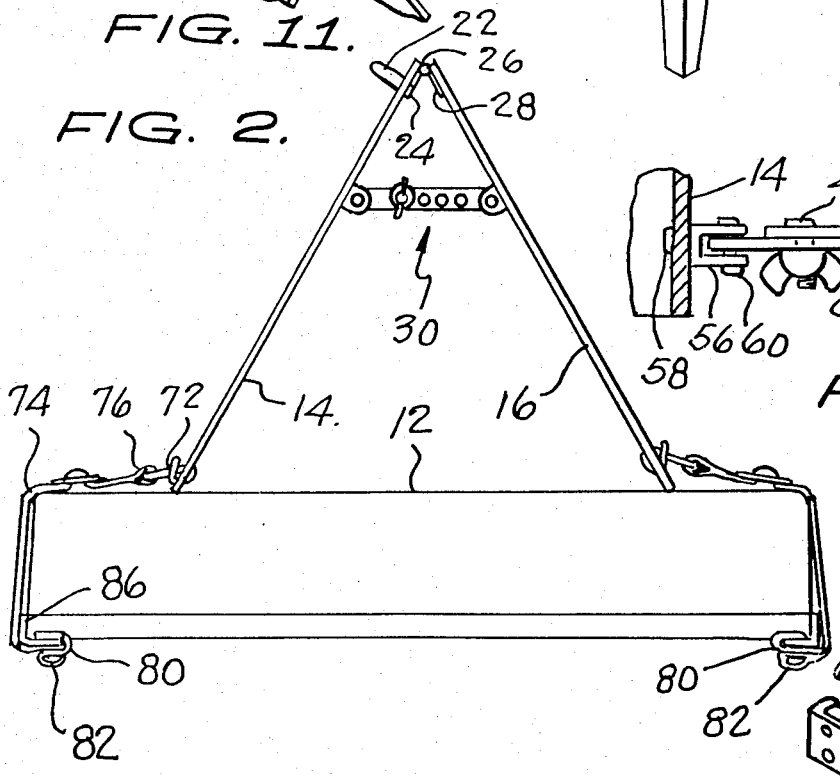
FIG. 2.
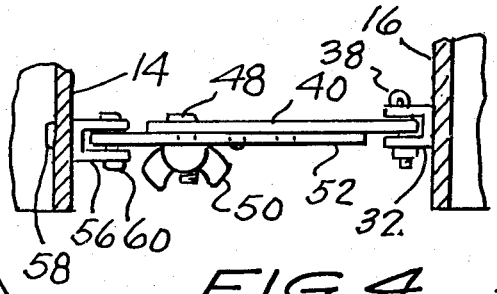
FIG. 3.
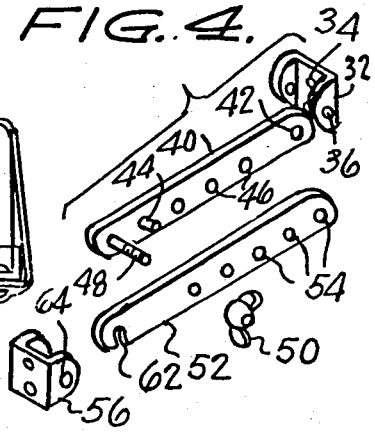
FIG. 4.

FIG. 5.
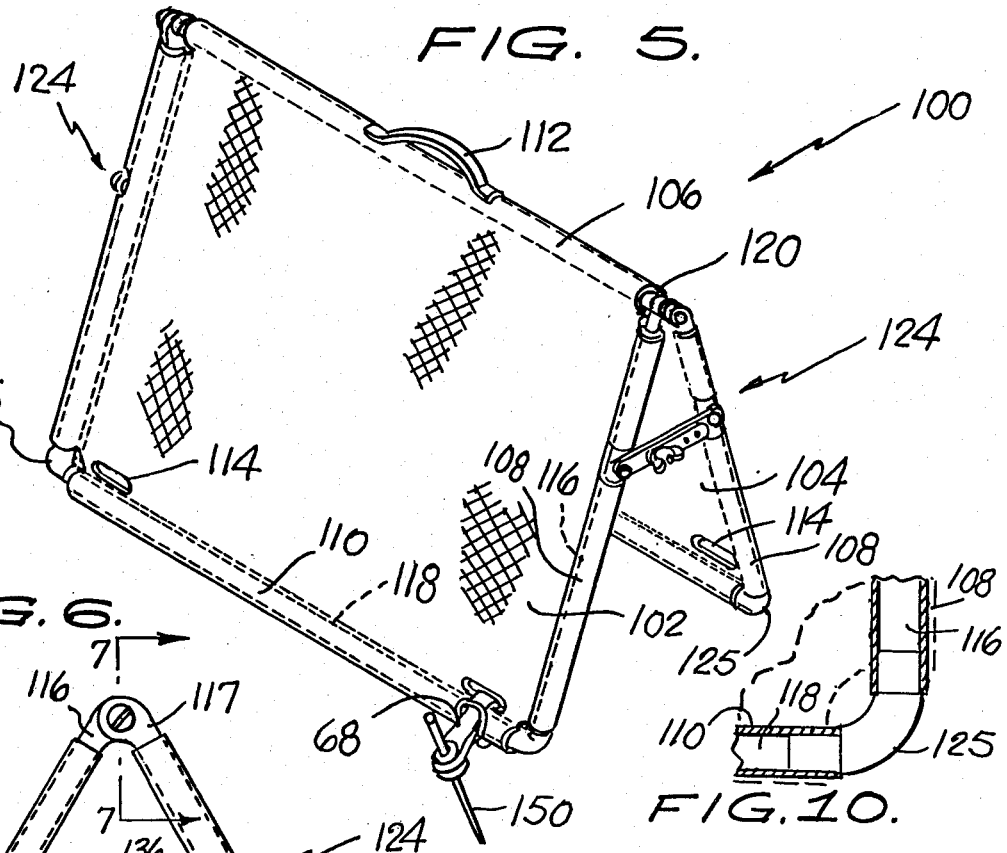
FIG. 6.
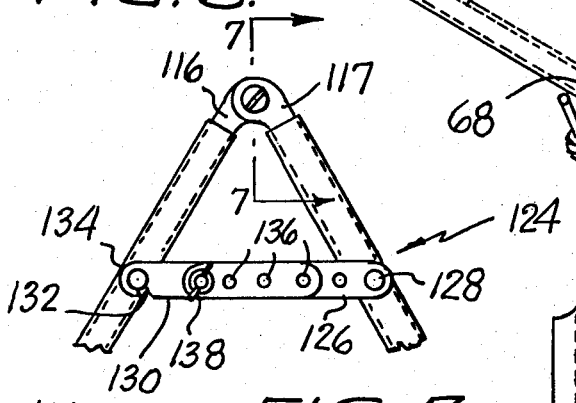
FIG. 7.
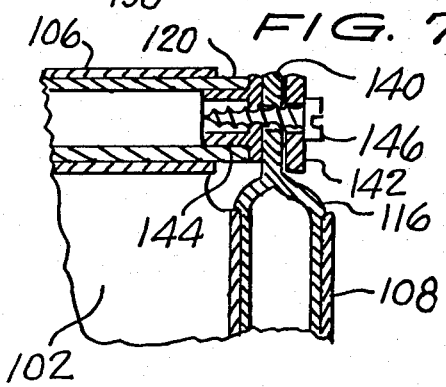
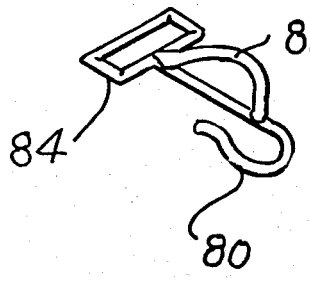
FIG. 9.
FIG. 10.
FIG. 8.
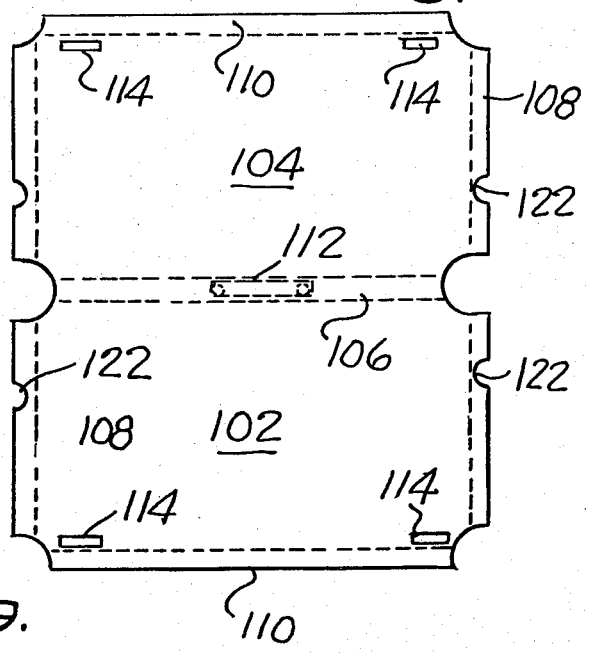

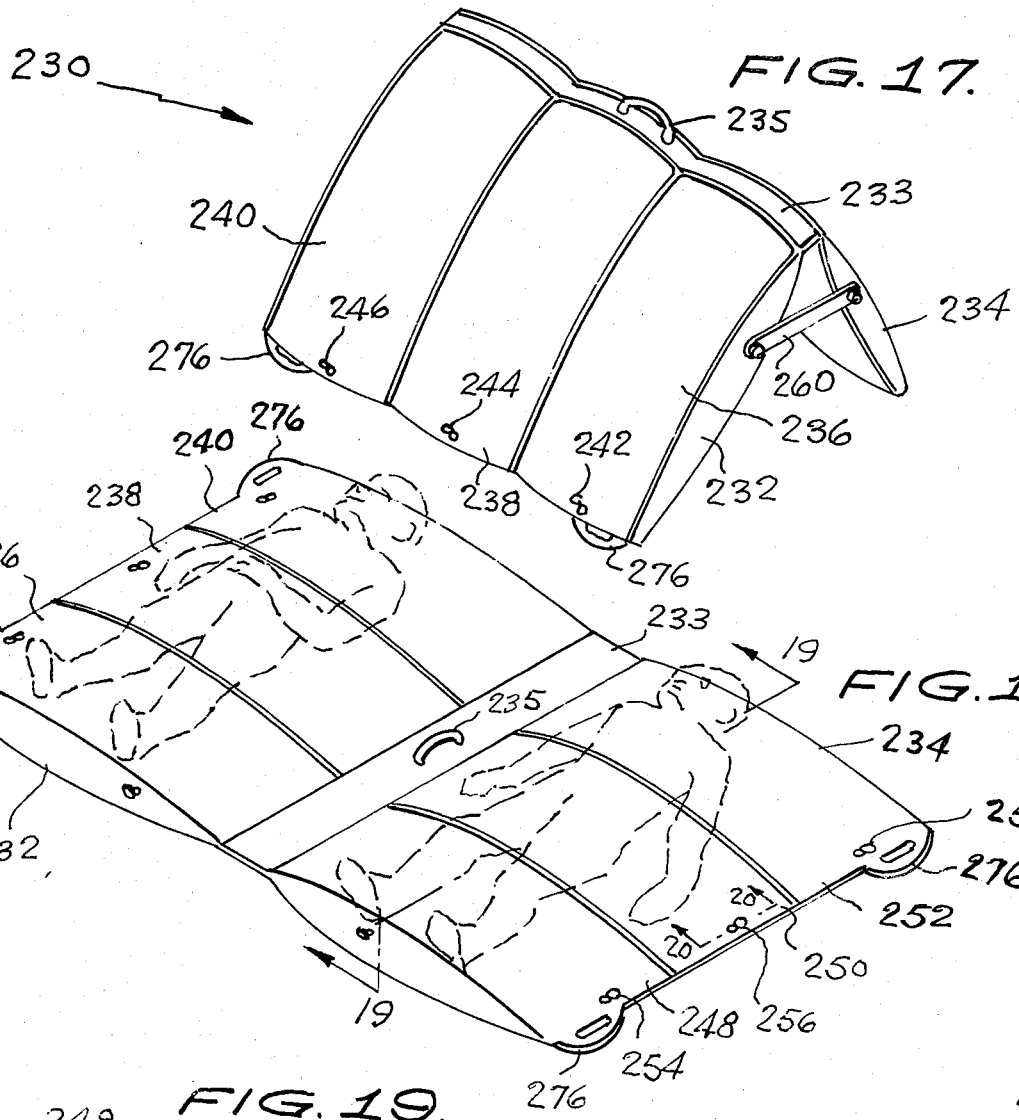
FIG. 17.
FIG. 18.
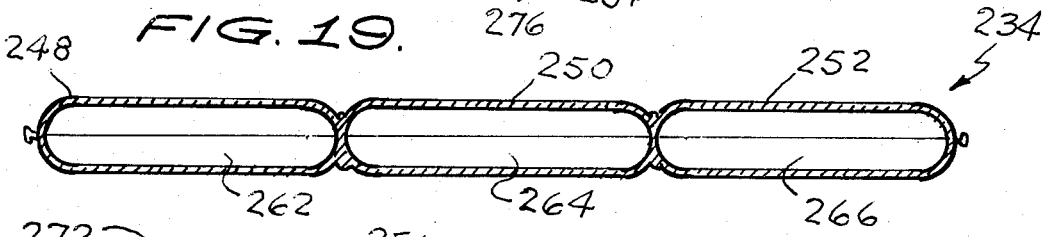
FIG. 19.
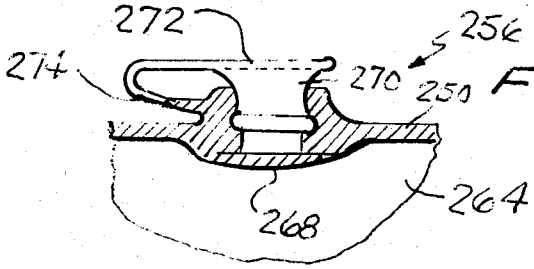
FIG. 20.

BED TENT

CROSS REFERENCE TO RELATED APPLICATION

This application is a continuation-in-part of my prior application Ser. No. 850,496, filed Nov. 11, 1977, now abandoned.

BACKGROUND OF THE INVENTION

1. Field of the Invention

The present invention is related to tent structures and, more particularly, is directed towards a versatile toy tent apparatus which may be utilized either indoors or outdoors.

2. Description of The Prior Art

Prior art U.S. patents of which I am aware in this general art area include: 837,937; 1,892,378; 2,420,898; 2,600,501; 2,739,861; 3,522,635; and 3,807,104.

For example, the Webster patent (U.S. Pat. No. 3,807,104) teaches a portable aluminum structure comprising a pair of rectangular panels fastened together in a hinged manner along associated edges. The Miner patent (U.S. Pat. No. 2,420,898) teaches a soft-sided tent structure, while Bernstein (U.S. Pat. No. 1,892,378) sets forth a tent construction in combination with a bed.

OBJECTS AND SUMMARY OF THE INVENTION

It is one object of the present invention to provide a small, portable tent structure which may be utilized by a child either indoors or out.

Another object of the present invention is to provide a simple, portable tent structure which may be used in combination with a bed for simulating a camping situation for a child indoors.

A further object of the present invention is to provide a tent structure which may be utilized either indoors or out of doors, and which includes means for fastening same either to a bed frame or to the ground.

An additional object of the present invention is to provide a portable tent structure which includes means for adjusting the width thereof.

A still further object of the present invention is to provide a tent structure which is reversible, and which may be utilized as either a tent or a floating raft.

The foregoing and other objects are attained in accordance with one aspect of the present invention through the provision of a tent structure which comprises first and second substantially identical tent sides, means for joining adjacent longitudinal edges of the tent sides so as to form a V-shaped structure, means connecting the tent sides for adjusting the angle therebetween, and means for fastening the tent sides to a support structure positioned thereunder. In one embodiment, the tent sides each comprise a substantially rectangular planar rigid board hingedly connected at their upper longitudinal edges. The means connecting the tent sides comprises first and second elongated rigid members, each of which may be pivotally mounted to the inside surface of the tent sides, the rigid members including pin and aperture means for adjustably securing same to one another.

In accordance with more specific aspects of the present invention, the first rigid member comprises a substantially flat, elongated bar that is pivotally mounted to the inside wall of one of the rigid boards and which includes a plurality of apertures formed therein for selectively receiving a retaining bolt, and a locating pin formed therein. The second rigid member comprises a substantially flat, elongated bar having a plurality of apertures formed near one end thereof for selectively receiving the retaining bolts and the locating pin of the first rigid member, and a slot is formed at the other end of the second rigid member for securing same to a retaining bolt mounted on the inside wall of the other of the rigid boards.

In accordance with yet other aspects of the present invention, the tent sides include a slot formed near the four lower corners thereof, and the fastening means comprises four anchor straps which are releasably fastenable to the slots, the anchor straps each comprising a flexible member having a pair of closed loops one formed at each end thereof. In a preferred embodiment, the support structure comprises a bed, and the fastening means includes an elastic band connected to each of the anchor straps and a hook connecting the other end of the elastic band to the frame of the bed.

In accordance with still other aspects of the present invention, the tent sides may be comprised of a flexible material having loop portions formed along all peripheral edges thereof. Tubular frame members are further provided for placement within the loop portions to support the tent structure, and appropriate hinged connections and width adjusting means may be provided as is in the first embodiment.

In accordance with yet other aspects of the present invention, the means for joining adjacent longitudinal edges of the tent sides may comprise means for permitting the tent sides to be pivoted substantially three hundred and sixty degrees with respect to one another whereby the tent structure is rendered reversible. More particularly, the joining means can comprise a flexible joining member which extents longitudinally down the edges of the tent sides and which includes a pair of bifurcated grip members for respectively securing same to the edges of the tent sides. Alternately, the joining means may comprise a plurality of rigid bracket members, each having a guide slot and positioned at spaced locations along the edges of the tent sides, and a pivot rod extending through all of the guide slots of the bracket members. Each of the tent sides may include a figurine or decoration, or may be differently colored to achieve any desired aesthetic effect.

In accordance with yet another aspect of the present invention, the means for connecting the tent sides in the reversible embodiment preferably comprises a first rigid bracket member pivotally mounted to a side edge of one of the tent sides, a latch secured to an opposing side edge of the other of the tent sides, and a second rigid bracket member secured to the first rigid bracket member and terminating in upwardly and downwardly extending hook means for latching into the latch in either of the reversible positions of the tent structure. The first and second rigid bracket members preferably include pin and aperture means for adjustably securing same to one another to thereby permit the angle formed by the V-shaped structure to be varied.

In accordance with yet another aspect of the present invention, the tent sides may each comprise an inflatable structure which includes at least three separate inflatable sections each having its own air valve. Each of the inflatable sections on each side of the tent are preferably substantially rectangular and are joined to an adjacent section in the same tent side along a longitudinal edge thereof. The means for joining the inflatable tent sides preferably comprises an elongated flat web of flexible material which is preferably integrally formed with the inflatable sides.

BRIEF DESCRIPTION OF THE DRAWINGS

Various objects, features and attendant advantages of the present invention will be more fully appreciated as the same become better understood from the following detailed description of the present invention when considered in connection with the accompanying drawings, in which:

FIG. 1 is a perspective view illustrating one preferred embodiment of the present invention shown mounted on a bed;

FIG. 2 is a side view in elevation of the preferred embodiment illustrated in FIG. 1;

FIG. 3 is an enlarged, sectional view illustrating certain of the components of the preferred embodiment shown in FIG. 1 and taken along line 3—3 thereof;

FIG. 4 is an exploded, perspective view illustrating the components shown in FIG. 3 in greater detail;

FIG. 5 is a perspective view of an alternative preferred embodiment of the present invention;

FIG. 6 is a partially broken, end view of the alternate preferred embodiment shown in FIG. 5;

FIG. 7 is a cross-sectional view of the components illustrated in FIG. 6 and taken along line 7—7 thereof;

FIG. 8 is a plan view showing the fabric construction of the alternate preferred embodiment of the present invention shown in FIG. 5;

FIG. 9 is a perspective view of a preferred embodiment of an anchor member in accordance with the teachings of the present invention;

FIG. 10 is an enlarged, partially broken view of one component of the preferred embodiment of FIG. 5;

FIG. 11 is a perspective, partially broken view of an alternate construction for the embodiment of FIG. 1;

FIG. 17 is a perspective view of still another alternate embodiment of the present invention;

FIG. 18 is a perspective view of the embodiment of FIG. 17 but in another form of use;

FIG. 19 is a cross-sectional view of the structure illustrated in FIG. 18 and which is taken along line 19—19 thereof; and FIG. 20 is an enlarged, broken cross-sectional view of a valve member of FIG. 18 which is taken along line 20—20 thereof.

DETAILED DESCRIPTION OF THE PREFERRED EMBODIMENTS

Figure 12:
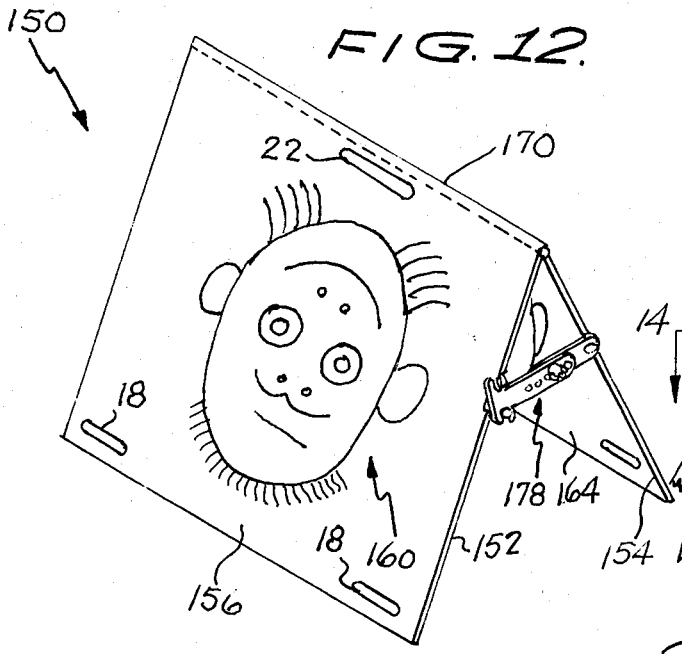
FIG. 12 is a perspective view of yet another embodiment of the present invention.

Referring now to the drawings, wherein like reference numerals represent identical or corresponding parts throughout the several views, and more particularly to FIG. 1 thereof, the tent structure of the present invention is indicated generally by reference numeral 10. The tent 10 of the present invention is illustrated in FIG. 1 in a preferred mode attached to a standard bed 12, in a manner to be described in greater detail hereinafter.

In the embodiment illustrated in FIGS. 1 and 2, the tent 10 of the present invention comprises a pair of rigid, rectangular substantially planar sides 14 and 16 which may be made of plywood, masonite, rigid plastic, or the like. Formed at the lower two corners of each of the rigid side members 14 and 16 are a pair of rectangular cutouts 18 and 20. Cutout 18 is formed substantially parallel to cutout 20, the latter of which opens outwardly along the lower edge 21 of boards 14 and 16. The purposes of slots 18 and 20 will be explained in greater detail hereinafter.

Formed near the upper central edge of board 14 is a handle member indicated by reference numeral 22. Handle 22 is preferably comprised of plastic, rope, or the like, so as to be flexible and lightweight. The handle 22 is preferably secured to the board 14 by securing means 24 which may comprise a mounting flange, a knot, or the like.

The upper lateral edges 26 of the boards 14 and 16 are joined together as by hinges 28 formed on their inner edges, as illustrated most clearly in FIG. 2. Alternatively, a cloth material or tape 29 may be secured along the edges 26 for providing a hinged connection for the two boards 14 and 16 as illustrated in FIG. 11.

It may be appreciated from FIGS. 1 and 2 that the rigid side members 14 and 16 form an inverted, substantially V-shaped structure whose apex, defined by longitudinal edges 26, forms a particular angle. The angle formed by the upper edges 26 of the tent structure 10 may be controlled by an adjustable support assembly which is indicated generally by reference numeral 30. As illustrated with greater particularity in FIGS. 3 and 4, the adjustable support assembly 30 includes a flange pivot bracket 32 which is secured to the side board 16. Pivot bracket 32 includes mounting holes 34 for securing same to board 16, and a pair of aligned pivot holes 36 formed in the side flanges of bracket 32 for receiving a pivot pin 38 which may comprise, for example, a conventional cotter pin.

The support assembly 30 further includes a first elongated member or bar 40 which includes an aperture 42 through which the pivot pin 38 extends. A locating pin 44 also extends from one side of the bar 40, and a plurality of apertures 46 are also formed through bar 40. A securing bolt 48 extends through one of the apertures 46 for securing bar 40 to a second elongated member or bar 52. A wing nut 50 or equivalent securing means may be provided to cooperate with bolt 48.

The second bar 52 also has a plurality of apertures 54 one of which is adapted to receive the locating pin 44, another of which receives the securing bolt 48. A second support bracket 56 is attached to the inside surface of board member 15 by means of a retaining bolt 58. Provided in the lateral flanges of support bracket 56 are a pair of aligned apertures 64 for receiving a latching bolt 60 which is permanently mounted thereto. Note that the distal end of the second bar 52 is provided with a slot 62 which may be secured about latching bolt 60.

To select the desired width of the tent structure 10, the bar members 40 and 52 may be laterally adjusted by means of locating pin 44 and bolt 48 to the desired width. After the bolt 48 has been secured through bars 40 and 52 by wing nuts 50, the pair of bars 40 and 52 may then be pivoted about pivot pin 38 to secure slot 62 about bolt 60.

The tent structure 10 may be secured to an understructure, such as bed 12, by four substantially identical tie down assemblies which are indicated generally by reference numeral 66 in FIG. 1. The tie down assemblies 66 each include an anchor strap 68 which may be either plastic or rope and includes a central elongated portion terminating at each end in a pair of loops 70 and 72. The central elongated portion of the straps 68 extends through the slots 18 and 20 in the rigid side members 14 and 16, while the loops 70 may be threaded through loop 72 to secure same.

The tie down assemblies 66 further include an elastic strip 74 having a hook 76 positioned at one end for attachment to loop 70. The elastic strip 74 is provided with an adjuster 78 for adjusting the tension therein, and a lower hook 80 is connected to the distal end for securing same to the underframe of the bed.

The lower hook 80, illustrated with greater particularity in FIG. 9, preferably includes a handle portion 82 and a slot 84 for receiving the elastic strips 74 therethrough. The hook portion 80 may be secured about the metal bed frame 86 (FIG. 2). Alternatively, if a wooden bed frame is present, the hook 82 may be secured by an appropriate spring thereof.

Referring now to FIGS. 5 through 8, an alternative embodiment of the present invention is indicated generally by reference numeral 100 and comprises generally a tubular support frame about which a soft sided tent covering is formed. The tent 100 comprises a pair of flexible sides 102 and 104 which may be made of cloth, plastic, canvas, or the like. As illustrated in a layout view in FIG. 8, the pair of flexible sides 102 and 104 include a loop shaped junction 106 for receiving an upper tubular support member 120 therethrough. The soft sides 102 and 104 each include a pair of opposed, parallel side loop receptacles 108 and a bottom loop receptacle 110. Loops 108 and 110 are each adapted to receive a tubular support frame, in a manner to be described in more detail hereinbelow.

A soft, flexible strap member 112 may be stitched to the central loop upper joint 106. Provided near the four corners of the tent structure are cutouts 114 to which the securing means, such as anchor straps 68, may be connected.

Reference numerals 116 and 117 indicate side tubular frame members, reference numeral 118 indicates bottom tubular frame members, while reference numeral 120 indicates the top tubular frame member. The side frame members 116 and 117 are interconnected with the bottom tubular frame members 118 by an elbow joint 125 which consists of an integrally formed elbow member that is adapted to be received within the open ends of the tubular frame members (see FIG. 10).

Cutouts 122 are provided (FIG. 8) in the side loop receptacles 108 for receiving the loop adjusting means indicated generally in FIGS. 5 and 6 by reference numeral 124. The structure and function of the width adjusting means 124 is substantially the same as the adjustable support assembly 30 of the first embodiment, with the exception of the mode of attachment to the frame members. More particularly, as illustrated in FIG. 6, the width adjusting means includes a first bar 126 which is pivotally connected as at 128 to the side tubular frame member 117. The first bar 126 includes a plurality of apertures which may be aligned with corresponding apertures 136 in a second bar 130. The bars 126 and 130 may be joined by bolt and nut assembly 138, and a slot 132 may be provided in the distal end of bar 130 for securing same to a projecting stud 134 from side tubular frame member 116.

Referring now to FIG. 7, the pivot connection of the side tubular frame members 116 and 117 is illustrated in sectional detail. The upper portion of the side tubular frame member 116 includes a planar flanged extension 140 having an aperture formed centrally therein. Likewise, the planar extended flange 142 of side tubular frame member 117 also has a central aperture therein which is aligned with the aperture in flange 140. A screw-receiving plug member 144 is mounted in the open end of top tubular frame member 120, and a screw 146 secures the flanges 140 and 142 to the receptacle 144 for pivotal movement.

Figure 13:
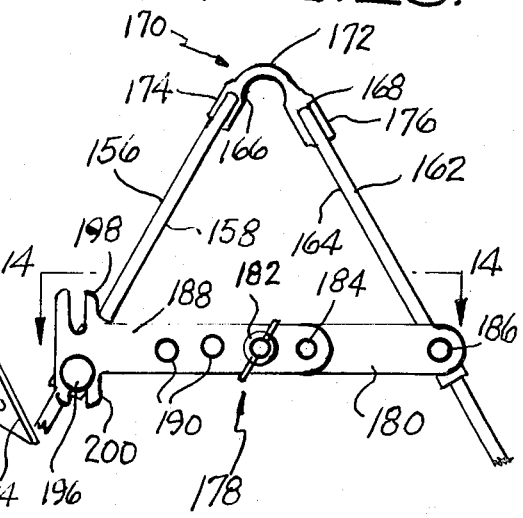
FIG. 13 is an enlarged, partially broken end view of the alternate embodiment illustrated in FIG. 12.
Figure 14:
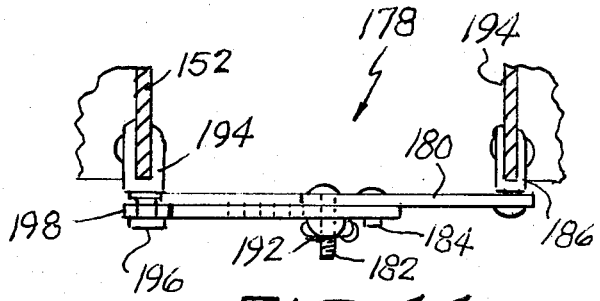
FIG. 14 is a sectional view of the embodiment illustrated in FIG. 13 and which is taken along line 14—14 thereof.

Referring now to FIGS. 12 through 14, an alternate embodiment of the present invention is illustrated and is seen to consist of a tent structure 150 which is reversible. The reversible tent 150 includes substantially planar, rigid side members 152 and 154 which are connected by a joint 170 which permits sides 152 and 154 to be pivoted substantially three hundred and sixty degrees with respect to one another.

More particularly, side member 152 includes two surfaces 156 and 158, each of which may be uniquely decorated to provide any desired aesthetic effect, regardless of the sides which are on the outside and the inside of the structure. For example, the outer surface 156 as illustrated in FIG. 12 may include a figurine 160 which may be in the form of a two-faced head. If the tent structure 150 were reversed, and surface 156 became an inside surface of the tent, a child inside the tent would still have an upright face to look at. Clearly, other figures, designs and colors could be utilized to render the tent structure 150 even more versatile.

Likewise, the other side member 154 includes an outer surface 162 and an inner surface 164, which may be reversed, and which may also include figurines or other designs.

The upper edges 166 and 168 of the side members 152 and 154 are joined by a reversible retaining member which is indicated generally by reference numeral 170. In one embodiment, the retaining member 170 comprises a central flexibly resilient portion 172 which terminates in a pair of bifurcated edge-encompassing grip members 174 and 176 which may be made of a resilient plastic biased so as to securely hold edges 166 and 168 therewithin. Alternately, the grip members 174 and 176 may simply consist of canvas cloth or heavy tape which may be secured by any suitable glue or the like to the top edges 166 and 168 of side members 152 and 154, respectively.

Referring now particularly to FIGS. 13 and 14, an adjustable and reversible support assembly is indicated generally by reference numeral 178. The support assembly 178 may be adjusted in width so as to provide any suitable angular opening for the V-shaped tent structure 150, and may also be utilized regardless of which of the two sets of surfaces of the tent sides are exposed. To this end, the support assembly 178 includes a first pivot bracket 180 having a threaded pin 182 and a short pin 184 extending from one surface thereof. Pivot bracket 180 is mounted to a lateral edge of one of the side members 154 by means of a pivot mount 186.

A second bracket 188 includes a plurality of apertures 190 through two of which extend pins 182 and 184 of pivot bracket 180. A wing nut 192 secures bracket 188 to bracket 180. Selection of various combinations of pivot apertures for receiving pins 182 and 184 determines the angle made by tent sides 152 and 154.

Fastened to the opposed side edge of the other tent side 152 is a support latch 194 having a fixed stud 196 extending therefrom. The end of the bracket 188 includes an upwardly extending hook 198 and a downwardly extending hook 200. As may be appreciated from FIG. 13, the downwardly extending hook 200 is utilized when surfaces 158 and 164 comprise the inside surfaces of tent structure 150, while hook member 198 cooperates with stud 196 when surfaces 156 and 162 serve as the inside surfaces of the tent structure when reversed.

Figure 15:
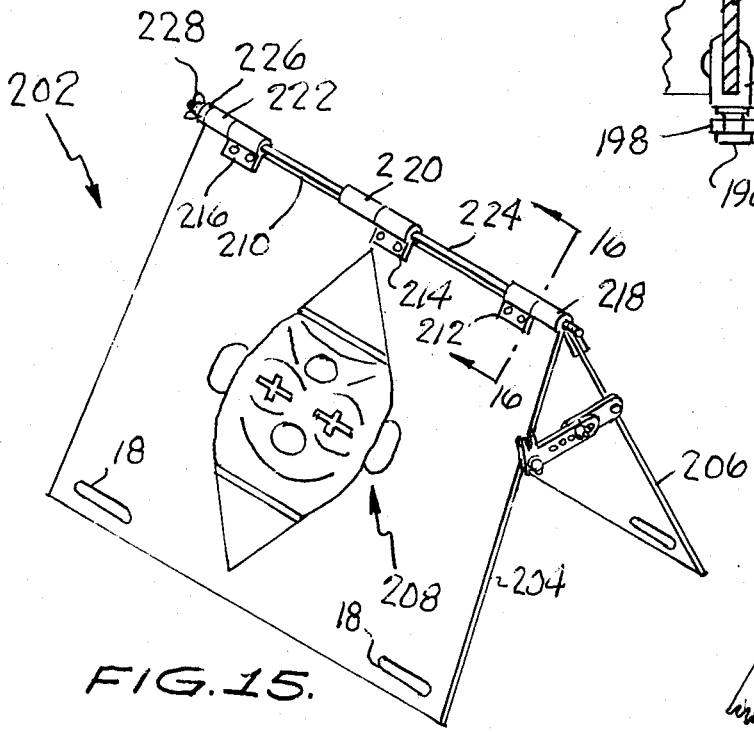
FIG. 15 is a perspective view of yet another embodiment of a tent structure in accordance with the present invention.
Figure 16:
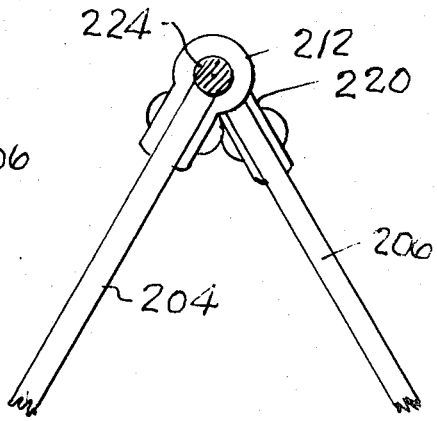
FIG. 16 is an enlarged, partially broken sectional view of the embodiment illustrated in FIG. 15 which is taken along line 16—16 thereof.

Referring now to FIGS. 15 and 16, a reversible tent 202 having an alternate loop hinge structure is illustrated. Tent 202 includes rigid tent sides 204 and 206 which may include figurines 208 painted thereon. Along an upper edge 210 of tent side 204 are mounted a plurality of spaced loop brackets 212, 214 and 216.

Similarly, along the upper edge of the other tent side 206 are positioned three additional loop brackets 218, 220 and 222, which may be substantially identical to the loop brackets 212 through 216. Clearly, greater or fewer number of loop brackets could be utilized, depending upon the size and weight requirements of the tent structure 202.

Extending through the looped portion of each of the brackets 212 through 222 is a pivot rod 224 which is as long as the edges 210 of the tent sides 204 and 206. The rod 224 may be secured by a washer 226 and wing nut 228. The structure of FIGS. 15 and 16 renders the tent sides 204 and 206 just as equally reversible as the member 170 of FIGS. 12 and 13.

Referring now to FIGS. 17 through 20, an alternate embodiment of the present invention is illustrated and is seen to consist of an inflatable and reversible tent 230 which may double for use as a flotation raft. As illustrated in FIG. 17, the tent 230 includes two sides 232 and 234 which are connected by a substantially flat web member 233 which is preferably integrally formed of the same material as the sides 232 and 234. A handle 235 may extend outwardly from the web section 233 for easy carrying.

Each of the sides 232 and 234 consist of a plurality of separate inflatable sections. This provides an added safety feature in that if one of the sections becomes deflated while on the water, the structure will remain afloat.

For example, the side 232 of the tent may include separate sections 236, 238 and 240, each of which is substantially rectangular and is joined to the next adjacent section in the same side along a longitudinal side edge thereof. The sections 236, 238 and 240 each have their own valves 242, 244 and 246, respectively, for easy inflating and deflating thereof.

Similarly, the other side 234 of the tent structure 230 includes inflatable sections 248, 250 and 252, each having its own valve 254, 256 and 258 respectively. The sections 248, 250 and 252 define individual air pockets 262, 264 and 266 respectively, which are separated from one another and are individually inflatable and deflatable via valves 254, 256 and 258, respectively.

A support strap 260 may be provided on each side edge of sides 232 and 234 and may be secured by simple snaps or the like.

The structure of one of the valves 256 is illustrated in greater detail in FIG. 20 and is seen to include a one-way flutter valve 268 having a blow tube 270 extending therefrom to the outer surface of section 250. A plug or stopper 272 is preferably integrally connected to section 250 by a connector 274 so as not be be lost therefrom. As air is blown into the chamber 264, the valve 268 is pushed downwardly, allowing the air to enter. Trapped air inside chamber 264 may not escape due to the positioning of flap 268 against the opening 270. The valve stem 270 is preferably vulcanized, and the tapered plug 272 is inserted into the valve stem 270 after the section 250 has been filled with air. The cap 272 prevents dirt or debris from getting into the valve 270 and also assists in preventing air from escaping.

It is clear from the foregoing that I have provided a novel, versatile, sturdy folding tent which is particularly adapted to be erected over a child's bed to provide the child with a sense of camping out under a tent in his own bed. The tent of the present invention was designed without any end closures since it eliminates any enclosed or trapped feeling that the same may generate in a child. When erected on a bed, the bedspread or top sheet may be pulled up over the rear of the tent to form the back or end cover. The bedspread or top sheet could provide as much front enclosure as the child desires. If it is too warm for covers, the tent may be utilized without same, the open end permitting air to freely circulate through the tent. Since many children tend to have quite a restless sleep, kicking their covers off and the like, the tent, when fastened on the bed, assists in holding the covers and child in place.

Obviously, numerous modifications and variations of the present invention are possible in light of the above teachings. For example, with respect to the first embodiment, the rigid-sided tent structure may be utilized as a desk, backrest, animal shelter, doll house, or other children's toy. The tent provides a good reclining backrest while watching television, reading, or just relaxing. It may be turned sideways across the end of a bed, or set up on the floor. Being portable, it may be set up in any room of the house, or even outdoors. The rigid-sided tents may be utilized as desks, while sitting on the floor, or as a low stool. With or without a blanket cover, the tent of the invention may be utilized as a temporary small animal shelter. Provided in various sizes to suit the need, the present invention could be utilized as a doll house, tunnel, garage, or the like. The structure of the present invention may be utilized as a protective device when placed over plants and flowers to protect them from a light freeze or hail.

Accordingly, it should be understood that within the scope of the appended claims, the invention may be practiced otherwise than as specifically described herein.

I claim as my invention:

1. A tent structure, which comprises:

first and second substantially identical tent sides;

means for joining adjacent longitudinal edges of said tent sides so as to form a V-shaped structure;

means connecting said tent sides for adjusting the angle therebetween; and means for fastening said tent sides to a support structure thereunder;

wherein said tent sides each comprise a substantially rectangular planar rigid board hingedly connected at their upper longitudinal edges;

wherein said means connecting said tent sides comprises first and second elongated rigid members, each of which may be pivotally mounted to the inside surface of said tent sides, said rigid members including pin and aperture means for adjustably securing same to one another, wherein said first rigid member comprises a substantially flat, elongated bar pivotally mounted to the inside wall of one of said boards and including a plurality of apertures formed therein for selectively receiving a retaining bolt, and a locating pin formed therein;

wherein said second rigid member comprises a substantially flat, elongated bar having a plurality of apertures formed near one end thereof for selectively receiving said retaining bolt and said locating pin of said first rigid member, and a slot formed at the other end thereof for securing same to a retaining bolt mounted on the inside wall of the other of said boards.

2. A tent structure, which comprises:

first and second substantially identical tent sides;

means for joining adjacent longitudinal edges of said tent sides so as to form a V-shaped structure;

means connecting said tent sides for adjusting the angle therebetween; and means for fastening said tent sides to a support structure thereunder;

wherein said tent sides include a slot formed near the four lower corners thereof, and said fastening means comprises four anchor straps releasably fastenable to said slots, said anchor straps each comprising a flexible member having a pair of closed loops one formed at each end thereof.

3. The tent structure as set forth in claim 2, wherein said support structure comprises a bed, and said fastening means includes an elastic band connected to each of said anchor straps, and a hook connecting the other end of said elastic band to the frame of said bed.

4. A tent structure, which comprises:

first and second substantially identical tent sides;

loop means integral and coextensive with adjacent longitudinal edges of said tent sides for joining same so as to form a V-shaped structure having open front and rear ends;

means connecting said tent sides for adjusting the angle therebetween; and means for fastening said tent sides to a support structure thereunder;

wherein said tent sides are comprised of a flexible material having loop portions formed along all peripheral edges, and further comprising tubular frame members for placement within said loop portions and said loop means to support said tent structure.

5. A tent structure, which comprises:

first and second substantially identical tent sides;

means for joining adjacent longitudinal edges of said tent sides so as to form a V-shaped structure;

means connecting said tent sides for adjusting the angle therebetween; and wherein said means for joining adjacent longitudinal edges of said tent sides comprises means for permitting said tent sides to be pivoted substantially 360° with respect to one another whereby said tent structure is reversible.

6. The tent structure as set forth in claim 5, wherein said joining means comprises a flexible joining member extending longitudinally down said edges and including a pair of bifurcated grip members for respectively securing same to said edges of said tent sides.

7. The tent structure as set forth in claim 5, where said joining means comprises a plurality of rigid bracket members each having a guide slot and positioned at spaced locations along said edges of said tent sides, and a pivot rod extending through all of said guide slots of said bracket members.

8. The tent structure as set forth in claim 5, wherein each of said tent sides includes a figurine for decorative purposes.

9. The tent structure as claimed in claim 5, wherein said means for connecting said tent sides comprises a first rigid bracket member pivotally mounted to a side edge of one of said tent sides, a latch secured to an opposing side edge of the other of said tent sides, and a second rigid bracket member secured to said first rigid bracket member and terminating in upwardly and downwardly extending hook means for latching onto said latch in either of the reversible positions of said tent structure.

10. The tent structure as set forth in claim 9, wherein said first and second rigid bracket members include pin and aperture means for adjustably securing same to one another to thereby vary the angle formed by said V-shaped structure.

11. The tent structure as set forth in claim 5, further comprising means for fastening said tent sides to a support structure thereunder.

12. The tent structure as set forth in claim 2 or 5, wherein said tent sides each comprise an inflatable structure.

13. The tent structure as set forth in claim 12, wherein each of said tent sides includes at least three separate inflatable sections each having its own air valve.

14. The tent structure as set forth in claim 13, wherein each of said sections are substantially rectangular and are joined to an adjacent section in the same tent side along a longitudinal edge thereof.

15. The tent structure as set forth in claim 13, wherein said means for joining said tent sides comprises an elongated flat web of flexible material.

* * * * *